US005110042A

United States Patent [19]

Hurden

[11] Patent Number: 5,110,042

[45] Date of Patent: May 5, 1992

[54] CARTONS WITH POURING SPOUTS

[75] Inventor: Derek Hurden, St. Neots, England

[73] Assignee: Trenton Box Company Limited, England

[21] Appl. No.: 720,632

[22] Filed: Jun. 25, 1991

[30] Foreign Application Priority Data

Jun. 28, 1990 [GB] United Kingdom ..... 9014422

[51] Int. Cl.[5] ..... B65D 5/70; B65D 5/74

[52] U.S. Cl. ..... 229/215; 229/125.42

[58] Field of Search ..... 206/621.4, 621.5, 621.6, 206/621.8, 625; 229/125.42

[56] References Cited

U.S. PATENT DOCUMENTS

| | | | |
|---|---|---|---|
| 1,426,439 | 8/1922 | Zalkind | 206/621.4 |
| 2,348,140 | 5/1944 | Levin | 206/621.4 |
| 2,760,708 | 8/1956 | Phillips | 206/621.4 |
| 2,969,904 | 1/1961 | Cottrill | 206/621.5 |
| 4,054,240 | 10/1977 | LaPierre | 206/621.4 |
| 4,150,778 | 4/1979 | Engdahl, Jr. | 206/621.4 |
| 4,684,058 | 8/1987 | Weber | 206/621.4 |
| 4,896,824 | 1/1990 | Aoki | 206/621.8 |

*Primary Examiner*—Gary E. Elkins

*Attorney, Agent, or Firm*—Ostrolenk, Faber, Gerb & Soffen

[57] ABSTRACT

A rectangular carton having a pouring spout which is formed from material coming out of a vertical edge of the carton, i.e. of material on each side of this edge and which hinges about a line extending diagonally upwards across an end face from the vertical edge.

9 Claims, 2 Drawing Sheets

CARTONS WITH POURING SPOUTS

BACKGROUND OF THE INVENTION

1. Field of the Invention

The present invention relates to cartons and blanks for cartons, which are of rectangular form and have a pouring spout. While most rectangular cartons are of oblong shape the term includes the case where some or all walls of the carton are square.

2. Description of the Related Art

Various kinds of pouring spouts have been provided in the past, however they often require extra materials such as metallic inserts or do not seal to the carton very well.

The present invention is concerned with these problems. Accordingly the present invention provides a carton blank for a rectangular carton which in made up form has a pouring spout, said pouring spout being defined by a diagonal hinge line extending upwardly across a first face of the carton from a first hinge point on a first vertical edge line between a second face of the carton and said first face, to a second hinge point on said first face, and the pouring spout will be in the form of two hinged panels at right angles to one another (and slightly less than 90° when open) the first of which is derived from said first face and the second of which comes from material in the region of the second face, that is closely adjacent and parallel to said second face, or from material of the second face itself. Preferably the second spout panel is located to slide between two supporting panels one of which is constituted by material of said second face and the other by an extension flap parallel to said second face.

The hinge line will generally be defined by single or double crease lines or intermittent cuts.

Preferably the carton blank comprises a cut line, which in the made up form of the carton, extends from the second said hinge point in a substantially horizontal direction across the said first face of the carton.

A second cut line is preferably provided, which in the made up form of the carton, extends from the first hinge point along a continuous convoluted path to join said substantially horizontal first cut line.

Preferably the said first face is an end face and a side securing flap extends from said first face, and said second cut line is wholly within said side securing flap.

An extension flap may extend from said side securing flap, which extension flap is, in the made up form, folded back from the securing flap to provide the inner of two supporting panels within which the second spout panel can slide. This gives greater rigidity to the pouring spout when in the pouring position, and also helps to seal the carton against seepage.

In order to gain access to the pouring spout for use, preferably a vertical tear strip is defined by tear lines in an edge of a side wall opposed to the second face of the carton so that when made up it provides access to the pouring spout, and prior to being torn open assists in the sealing of a carton, in a tamper proof manner.

As previously mentioned, the second cut line should preferably extend wholly within a side securing flap. The second cut line should be of a shape which enables the spout to pivot outwards without difficulty. In a preferred arrangement which achieves this objective, the cut line at its upper edge opens out into a cut-out and its shape is arcuate to allow for an arcuate movement when opening out the spout. The arcuate shape provides a camming action controlling movement of the spout, and in a preferred arrangement the arcuate shape straightens out in a last phase of defined movement to inhibit further movement of the spout beyond a desired open position.

BRIEF DESCRIPTION OF THE DRAWINGS

An embodiment of the invention will be described by way of example with reference to the accompanying diagrammatic drawings in which.

DETAILED DESCRIPTION OF THE INVENTION

Figure 1:
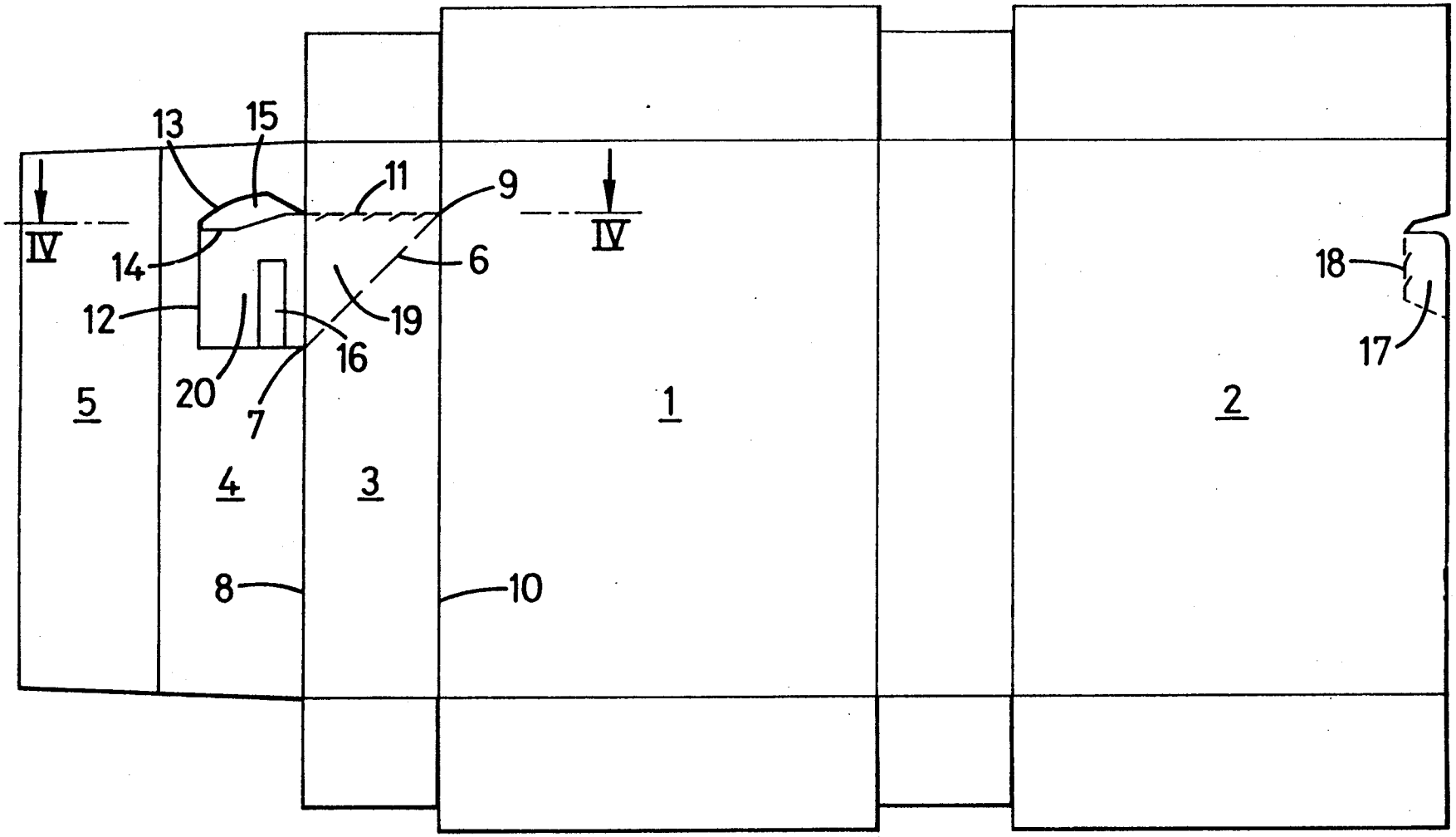
FIG. 1 is a plan view of a blank for a carton in accordance with the invention.

Referring to FIG. 1, the blank comprises rectangular panels 1 and 2 which define the major side faces of the carton, a panel 3 defining an end face in which a pouring spout is located, a panel 4 defining a securing flap and a panel 5 defining an extension to the securing flap. Bottom and top sealing flaps and the rear end flap are also defined within the blank but are perfectly standard in shape and form.

A diagonal hinge line 6 including spaced cuts extends upwardly across the panel 3 from a first hinge point indicated by arrow 7 on an edge line 8 between panel 4 and panel 3 to a second hinge point indicated by arrow 9 on edge line 10 between panels 3 and 1.

A first cut line 11 formed from spaced cuts which can be easily torn open extends transversely from the second hinge point 9 across the end face 3 of the carton so that in the upright position of the set up carton this line is substantially horizontal. The line extends the whole way across the face 3.

A second line 12 extends from the first hinge point 7 along a convoluted part rectangular path to join the first cut line 11. At its upper edge the cut line 12 branches into two lines 13 and 14 of pre-chosen shape to form a cut out aperture 15 in the board material.

Thus, the lines 6, 11 and part of 8 define a first spout panel 19, while the lines 12, 14 and the same part of 8 define a second spout panel 20.

The lines 13 and 14 are part arcuate in form so that in the made up condition of the carton, the spout can move to the opened out condition while remaining substantially in the plane of its own board material.

The shape of the line 13 is arcuate for approximately two thirds of its length and this defines movement of the corner of panel 20 by a camming action during opening of the pouring spout. Thereafter the line 13 straightens out to travel in a straight direction back to the junction with edge line 8. This then acts to inhibit the pouring spout against opening too far.

Within the region defined by the lines 12 and 14, is a rectangular glue strip 16 which holds the spout together in the erected pre-opened condition. This glue line needs to remain within the region defined by the lines 12 and 14 to ensure that adhesion only occurs where required. It has the important function of holding the pouring spout firmly closed during packing, transport and handling prior to opening.

Finally on the carton blank, there is a tear strip 17 defined by spaced cuts 18 and located on the extreme right-hand edge of the panel 2 so that in the erected condition it comes up into the region of the pour spout cut lines previously discussed.

The use of the glue line 16 and tear strip 17 is an optional feature, and in some uses can be omitted provided a thumb access hole is provided in place of the tear away strip 17.

For erection of the carton, the first stage is to fold the extension flap back onto the sealing flap 4 and seal it in position. The carton is then made into a sleeve by sealing the sealing flap 4 under the main panel 2. Cartons in this sleeve form are then normally supplied by the carton manufacturer to the user who is to fill and subsequently seal the carton on standard machinery.

Figure 2:
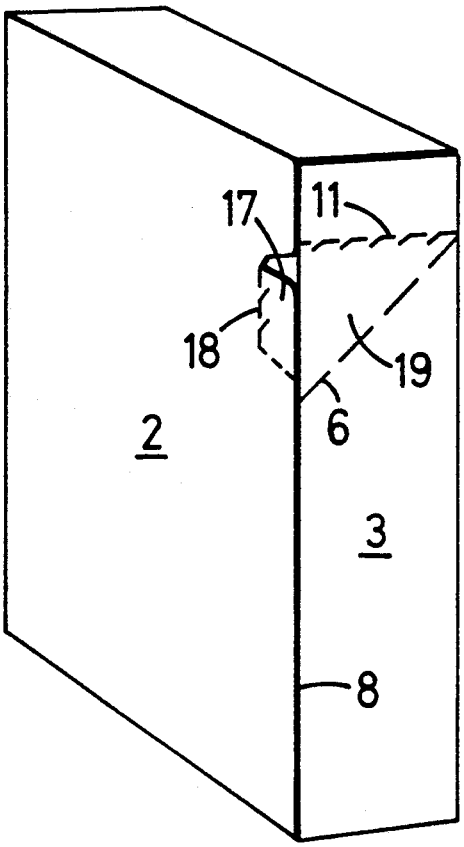
FIG. 2 shows the carton in made up form before opening out the spout.

Then, when fully erected the carton has the appearance shown in FIG. 2.

Figure 3:
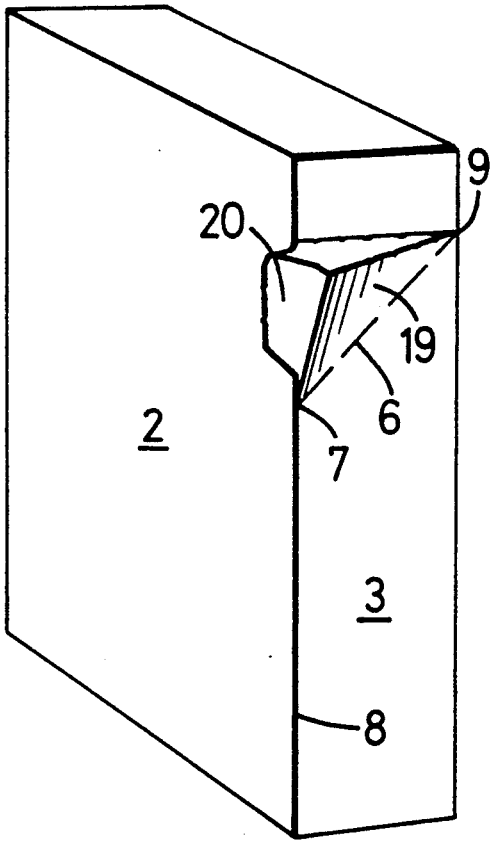
FIG. 3 shows a perspective view of the carton with the pouring spout opened out.
Figure 4:
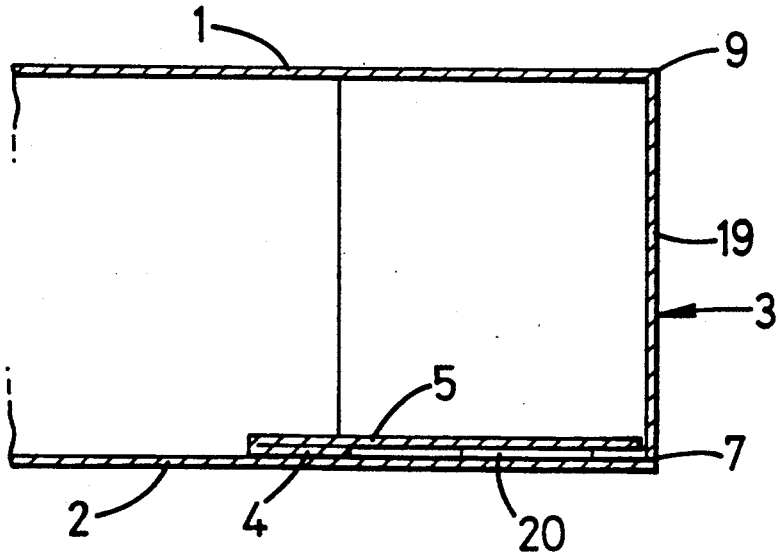
FIG. 4 is a fragmental plan view of the erected carton sectioned on the lines IV—IV of FIG. 1.

The vertical tear strip 17 can then be torn away; and, by thumb pressure, the pouring spout can be opened out as shown in FIG. 3. Referring to FIG. 4 which looks down sectionally on the pour spout part of the carton, it can be seen that spout panel 20 can pivot outwards about the pivot point 7 while sandwiched between the layers defined by panels 5 and 2, and lying substantially within its own plane (albeit with slight flexure at its outer end). This provides positive location of the pour spout in use, and also minimizes the risk of seepage when the pour spout is closed after use. Moreover the difference in shape of the two lines 13 and 14 combined with the camming shape of the line 13 is such as to permit opening of the carton to the pouring position, but to lock the pouring device against further movement, by the camming action as previously described.

I claim:

1. A carton having a pouring spout, said pouring spout being defined by a diagonal hinge line extending upwardly across a first panel of the carton between a first hinge point on a first vertical edge line and a second hinge point on said first panel, said first vertical edge line being disposed between a second panel and said first panel, wherein said pouring spout comprises two hinged spout panels disposed substantially perpendicular to each other, the first of said spout panels being cut out from said first panel and the second of said spout panels being cut out from said second panel, said second spout panel being disposed so as to slide between two supporting panels during opening and closing of said pouring spout, one of said supporting panels being an extension flap connected to said second panel.

2. A carton according to claim 1, further comprising a cut line extending from said second hinge point in a substantially horizontal direction across said first panel of the carton.

3. A carton according to a claim 2, further comprising a second cut line extending from the first hinge point along a continuous convoluted path within said second panel to join said substantially horizontal first cut line.

4. A carton according to claim 3, wherein said first panel is an end face and said second panel is a side securing flap, wherein said second cut line is wholly within said side securing flap.

5. A carton according to claim 4, wherein said extension flap extends from said side securing flap and is folded against the securing flap to provide said one of said two supporting panels between which the second spout panel can slide.

6. A carton according to claim 1, further comprising a vertical tear strip which is defined by tear lines in the second supporting panel wherein said tear strip, prior to being torn away, assists in sealing the carton as a tamper proof feature and, upon being torn away, permits said pouring spout to be opened.

7. A carton according to claim 3, wherein said second cut line, at an upper edge, opens into a cutout having an arcuate shape enabling arcuate movement when opening said pouring spout.

8. A carton according to claim 7, wherein said arcuate shape extends to a midpoint in said second panel, said cutout continuing from said midpoint to said first vertical edge line in a straight line thereby limiting outward movement of said pouring spout.

9. A carton comprising:

first and second face panels; said first and second face panels connected by a first end panel, wherein a hinge line is disposed between each of said panels;

a second end panel connected by a hinge line to said first face panel at a side opposite said first end panel;

a securing flap connected by a hinge line to said second end panel at a side opposite said first face panel; and an extension panel connected by a hinge line to said securing flap at a side opposite said end panel; wherein a pouring spout defined by a diagonal hinge line extending upwardly across said second end panel between the hinge lines of said securing flap and said first face panel, said pouring spout having first and second hinged spout panels, said first spout panel being cut out from said second end panel and said second spout panel being cut out from said securing flap, said second spout panel being disposed so as to slide between said extension panel and said second face panel during opening and closing of said pouring spout.

* * * * *